US008181499B2

(12) United States Patent
Ingvarsson

(10) Patent No.: US 8,181,499 B2
(45) Date of Patent: May 22, 2012

(54) ROLL-FORMING MACHINE AND METHOD FOR ROLL-FORMING A HAT-SHAPED PROFILE

(75) Inventor: Lars Ingvarsson, Borlange (SE)

(73) Assignee: Ortic 3D AB, Borlange (SE)

( * ) Notice: Subject to any disclaimer, the term of this patent is extended or adjusted under 35 U.S.C. 154(b) by 889 days.

(21) Appl. No.: 11/988,122

(22) PCT Filed: Jul. 10, 2006

(86) PCT No.: PCT/SE2006/000854

§ 371 (c)(1),
(2), (4) Date: Dec. 28, 2007

(87) PCT Pub. No.: WO2007/008152

PCT Pub. Date: Jan. 18, 2007

(65) Prior Publication Data

US 2009/0113974 A1 May 7, 2009

(30) Foreign Application Priority Data

Jul. 11, 2005 (SE) ..... 0501650

(51) Int. Cl.
*B21D 5/08* (2006.01)

(52) U.S. Cl. ..... 72/178; 72/181

(58) Field of Classification Search ..... 72/179, 72/181, 187, 176–178, 224, 225
See application file for complete search history.

(56) References Cited

U.S. PATENT DOCUMENTS

| | | | | |
|---|---|---|---|---|
| 3,903,723 | A | 9/1975 | Colbath | |
| 4,006,617 | A | 2/1977 | Foster | |
| 4,558,577 | A | 12/1985 | Trishevsky et al. | |
| 5,237,846 | A * | 8/1993 | Brooks, Jr. | 72/177 |
| 2004/0244454 | A1 * | 12/2004 | McDonald | 72/181 |

FOREIGN PATENT DOCUMENTS

| | | |
|---|---|---|
| DE | 750393 | 1/1945 |

* cited by examiner

*Primary Examiner* — Debra Sullivan
(74) *Attorney, Agent, or Firm* — Mark P. Stone

(57) ABSTRACT

A beam with a hat-shaped profile with a cross-section that varies along its length is successively formed from a plane sheet metal strip using a roll-forming machine with a number of forming stations. The forming stations (11, 12) have a pair of clamping rollers (21, 22 and 23, 24) for each side flange (16, 17) and support rollers (25, 26) for the central flange. The pairs of clamping rollers in the forming stations can be displaced both horizontally and vertically during a forming operation, and the support rollers (25, 26) can be displaced vertically and they can be displaced individually in a sideways direction. All four corners (27-30) of the hat-shaped beam are formed at the same time, whereby the corners are folded on the peripheral edges of the clamping rollers and support rollers. Not only the axes of the pairs of clamping rollers but also of the support rollers can be turned in order to adapt to the corners that are being formed.

20 Claims, 3 Drawing Sheets

10
10
20
21
22
23
24
25
26
27
28
29
30
31
32
33
34
35
40
41
42
43
44
13
14
15
16
17
I
II
III
IV
V
VI
VII
VIII

ROLL-FORMING MACHINE AND METHOD FOR ROLL-FORMING A HAT-SHAPED PROFILE

TECHNICAL AREA

The present invention relates to a method for roll-forming from a plane sheet metal strip successively in a number of forming stations a hat beam with a profile that varies along its length, having a central flange, two webs and two side flanges. The invention relates also to a roll-forming machine with a number of forming stations for successively forming from a plane sheet metal strip a hat beam, having a central flange, two webs and two side flanges and a cross-section that varies along its length.

THE PRIOR ART

The roll-forming of beams with a cross-section that varies along the length of the beam is known through DE 10011755 B4 and DE 1339508 B1.

AIM OF THE INVENTION

It is one aim of the invention to be able to roll-form in a simple way a beam with a hat-shaped profile that varies along its length.

BRIEF DESCRIPTION OF THE INVENTION

The method according to the invention is characterised primarily in that each side flange is clamped in the forming stations between a pair of clamping rollers and all four corners of the hat beam are formed at the same time between the said two pairs of clamping rollers and at least one support roller for the central flange, the corners are folded on the peripheral edges of the clamping rollers and the peripheral edges of the support rollers and the webs extend between the respective corner at least one of the clamping roller pairs and the support roller is displaced during the forming process in order to change the profile of the hat beam.

The roll-forming machine according to the invention is characterised primarily in that the forming stations have one pair of clamping rollers for each side flange and at least one support roller for the central flange, and the clamping roller pairs in the forming stations are arranged to be displaceable both horizontally and vertically during a forming operation.

Other characteristics are made clear by the patent claims.

DESCRIPTION OF ILLUSTRATED EMBODIMENT OF THE INVENTION

EP 1339508 B1 describes a complete roll-forming machine and is incorporated herein by way of reference. A complete roll-forming machine is not described below but only two of the roll-forming stations of the roll-forming section thereof are described.

Figure 1:
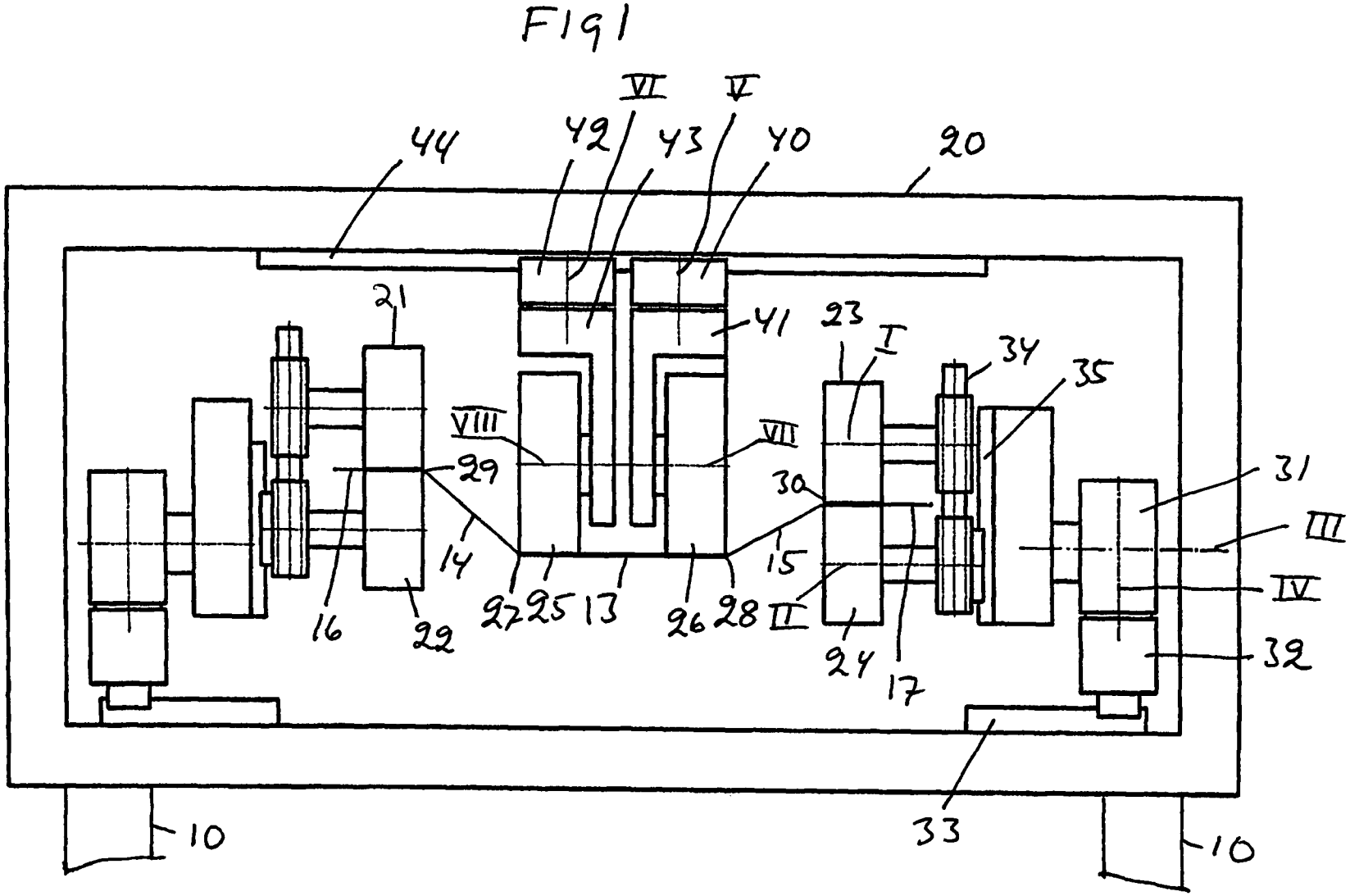
FIG. 1 is a schematic cross-section of one of the intermediate roll-forming stations in a roll-forming machine according to the invention.
Figure 2:
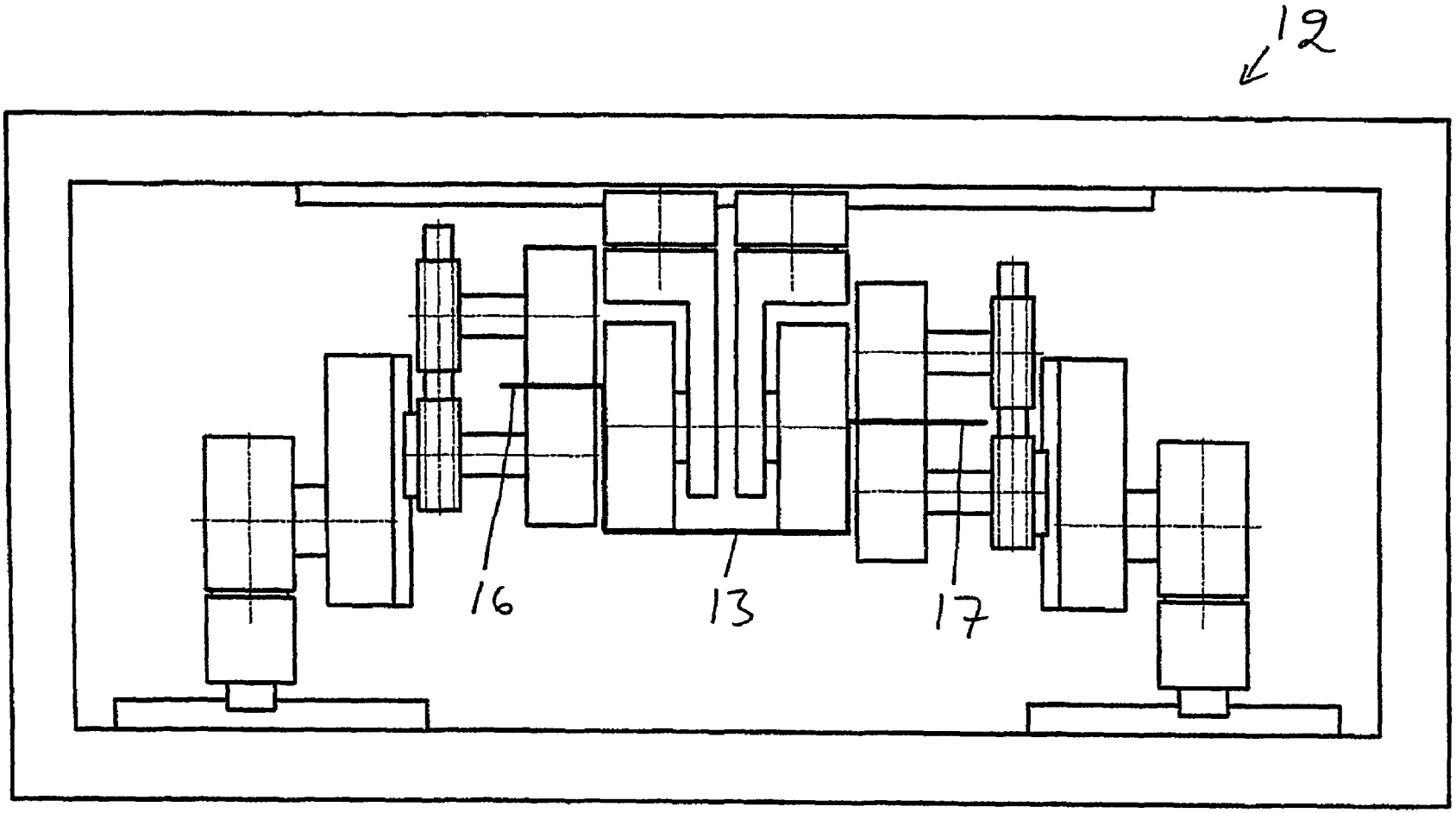
FIG. 2 is a schematic cross-section of the final roll-forming station in the roll-forming machine.

A roll-forming section has a support stand 10 that supports a number of roll-forming stations. FIG. 1 shows one of the intermediate roll-forming stations that has the reference number 11. FIG. 2 shows the final forming station 12 in the forming section. All forming stations may be similar, which give great flexibility when manufacturing different hat-shaped profiles.

The two forming stations shown are the same and they are symmetrical. Each forming station forms the entire cross section of the metal strip. For this reason, only one half of the forming station 11 will be described in detail. The hat-shaped beam that is in the process of being formed has a central flange 13, two webs 14, 15 and two side flanges 16, 17. The forming station 11 has a frame 20 that supports a pair of clamping rollers 21, 22 that clamp, i.e. the rollers retain by friction, one side flange 16, and it has a pair of clamping rollers 23, 24 that clamp between them the other side flange 17. The forming station has also a pair of support rollers 25, 26 for the central flange 13. The webs 14, 15 are bent upwards around the peripheral edges of the support rollers 25, 26 such that the corners 27, 28 of the hat-shaped beam are formed. The two other corners 29, 30 of the hat-shaped beam are folded around the peripheral edges of the lower rollers 22, 24 by the pairs 21, 22; 23, 24 of clamping rollers. The webs 14, 15 are thus held freely stretched between the corners 29, 27 and 30, 28.

The clamping rollers 23, 24 are supported by a vertical guide rail 35 for motion perpendicular to the horizontal axes I and II of the clamping rollers. The guide rail 35 is supported by a support 31, 32 and it can be rotated around a horizontal axis III that is parallel with the horisontal axes I and II of the clamping rollers. The lower part 32 of the support 31, 32 in turn is supported on a transverse horizontal rail 33 in the frame 13 in a manner that allows translation. The upper part 31 of the support 31, 32 is supported by the lower part 32 in a manner that allows rotation around a vertical axis IV. The distance between the clamping rollers can be adjusted by a manual screw setting 34 such that an appropriate clamping force against the side flange 17 is obtained. The pair of clamping rollers 21, 22 is supported in the same manner as the pair of clamping rollers 23, 24, as a mirror image.

The two support rollers 25, 26 are supported by supports 40, 41 and 42, 43 that are supported by a transverse horizontal rail 44 in the frame 20 in a manner that allows translation. The lower parts 41 and 43 of the supports are supported in a manner that allows rotation by the upper parts 40, 42 such that they can be rotated around vertical axes V, VI that are perpendicular to the axes VII, VIII of the clamping rollers 23, 24. The lower parts 41, 43 of the supports can be also vertically displaced relative to the upper parts 40, 42.

All displacements and all rotations (turnings) are carried out by power devices that may be hydraulic or electrical. These devices are not shown in the schematic drawings. The actions of the powers devices are controlled by a computer.

In order to form a hat-shaped profile (a hat beam) from a plane sheet it is appropriate to use 5-6 roll-forming stations. The forming station 11 shown in FIG. 1 can in this case be the third station, while that shown in FIG. 2 is the final forming station 12. When a hat beam with a profile that is constant along its length is formed all forming stations are set to be fixed. When a hat beam with a cross-section that varies along its length is formed, such as the beam that is shown in FIG. 3, the power devices are controlled by the computer during the forming operation following pre-programmed algorithms.

The support rollers 25, 26 may have counter-rollers on the lower surface of the central flange 13 but such counter-rollers are not necessary.

Figure 3:
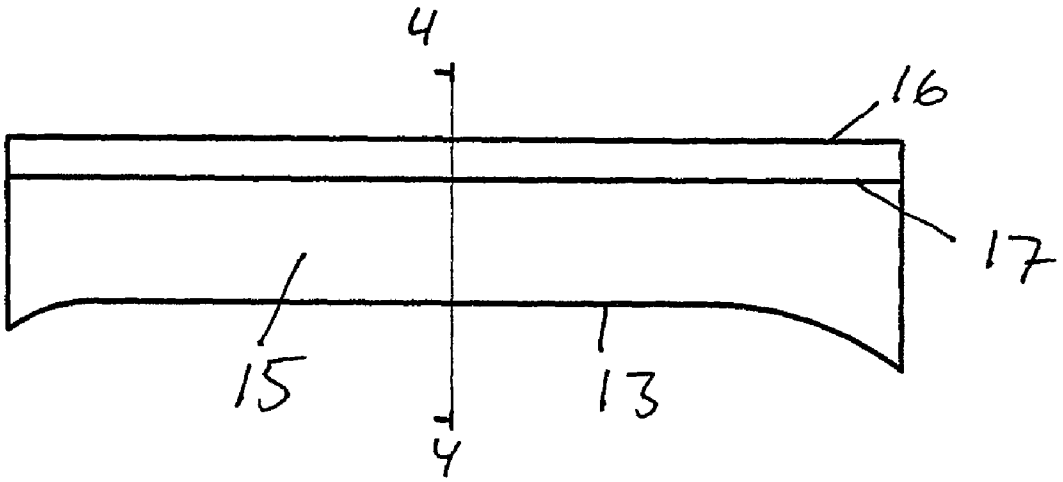
FIG. 3 is a side view of a beam with a hat-shaped profile roll-formed as specified by the invention.
Figure 4:
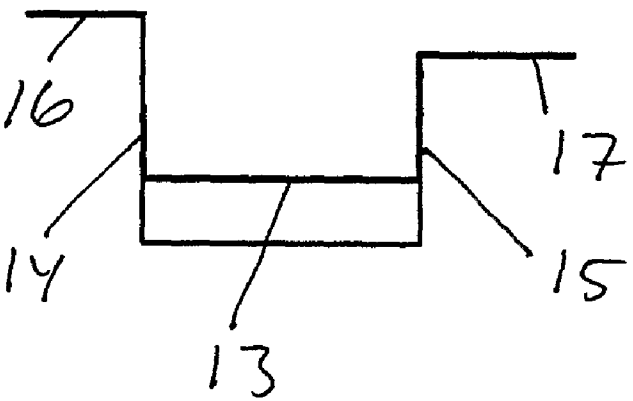
FIG. 4 is a cross-section of the beam in FIG. 3 taken as is shown by the arrows 4-4 in FIG. 3.

The beam shown in FIG. 3 has straight side flanges 16, 17 that are plane, but lie in two different planes. The central flange 13 has a constant width, but the heights of the webs 14, 15 vary along the length of the beam. During the forming of this beam the support rollers 25, 26 are displaced in a vertical direction in the forming stations, while the pairs of clamping rollers 21, 22; 23, 24 are displaced both horizontally and vertically. It is appropriate that the angle of the webs is held constant in any one forming station, i.e. such that the forming station folds up the webs to equal degrees independent of variations in the heights of the webs.

It is possible also to form a beam with varying width of the central flange. In this case the support rollers 25, 26 are displaced along the guide rail 42 during the forming operation. The support rollers are turned (rotated) around the axes V and VI such that their axes are maintained always perpendicular to the corners 27, 28 of the hat-shaped beam. The pair of clamping rollers 23, 24 is turned in a similar manner around the axis IV such that the axes of the rollers are maintained always perpendicular to the edge 30 of the hat-shaped beam. The pair of clamping rollers 21, 22 is turned in an equivalent manner. It is even possible to manufacture a hat-shaped beam that is curved in a horizontal direction by displacing the support rollers 25, 26 in an asymmetrical manner along the guide rail 42.

When a hat-shaped beam is formed, that does not have a plane side flange 17, the pair 23, 24 of clamping rollers is turned around the axis III such that a line between the axes I and II of the clamping rollers is maintained always perpendicular to the side flange. An equivalent description is valid for the pair 21, 22 of clamping rollers.

The strip is fed through the roll-forming section by the forming stations, which have computer controlled motors for driving the forming rollers. When the central flange varies in width, the rotational speed of the roller pairs must be varied individually to avoid slipping since a roller pair must have higher rotational speed when it is moved transversely than when it is held fixed.

The roll-forming machine can be used to form pre-cut blanks in the form of short plane strips, and it can be used to form hat-shaped beams directly from a coil of metal strip. In this case, the edges of the metal strip can be cut to the shape desired using an edge-cutting unit in direct association with the first forming station. It is possible as an alternative to cut the edges of the strip after the forming operation, since the side flanges are directed outwards. The edge-cutting before forming is preferred, since the strip is always plane before the forming operation. The strip can be cut off completely or partially before the forming. It is possible to cut the strip directly before the forming while preserving a part in the centre of the strip, which later is to become the central flange, or preserving parts of the webs, which later are to become side flanges. These plane parts are subsequently easy to cut off finally, in direct association with the termination of the forming operation. This procedure using a strip whose integrity is maintained during the forming operation is preferred.

It is also possible to use form-cutters after the forming operation, but such a procedure will not be as flexible as the one in which only plane parts are cut.

The invention claimed is:

1. A method for roll-forming from a plane sheet metal strip successively in a number of forming stations (11, 12) a hat beam with a profile that varies along its length, having a central flange (13), two webs (14, 15) and two side flanges (16, 17);

the steps of said method comprising:

clamping the portions of the metal sheet to be formed as the side flanges (16, 17) in the forming stations (11, 12) between a pair of clamping rollers (21, 22; 23, 24) and forming all four corners (27-30) of the hat beam at the same time between two pairs of said clamping rollers (21, 22 and 23, 24) and at least one support roller (25, 26) for forming the central flange (13), wherein the forming of all four corners of the hat beam at the same time between two pairs of said clamping rollers and at least one support roller for forming the central flange comprises folding the corners on peripheral edges of the clamping rollers, and on peripheral edges of the support rollers, such that the entire webs are extending freely between the respective corners, and displacing at least one of the pairs of clamping rollers and the at least one support roller during the forming process for changing the profile of the hat beam.

2. The method according to claim 1, characterised in that the pairs of clamping rollers (21, 22 and 23, 24) are displaced both horizontally and vertically during a forming operation.

3. The method according to claim 1, characterised in that the support roller or support rollers (25, 26) for the central flange (13) is or are displaced in a direction that is perpendicular to the central flange.

4. The method according to claim 1, characterised in that at least one said support roller (25, 26) is used for each corner (27, 28) of the central flange (13), and in that said at least one support roller is displaced in a sideways direction during a forming operation to vary the width of the central flange, whereby the support rollers are turned such that their axes (VII, VIII) are maintained perpendicular to the corners (28, 27) that make contact with the respective said support roller.

5. The method according to claim 4, characterised in that the pairs of clamping rollers (21, 22 and 23, 24) are turned such that their axes (I, II) are maintained perpendicular to the corner (28, 27) of the hat beam, and that a line between the axes of the pairs of clamping rollers is maintained perpendicular to the side flanges (16, 17).

6. The method according to claim 1, characterised in that said displacements of said clamping and support rollers are carried out by means of power devices that are controlled by a computer according to pre-programmed algorithms.

7. The method according to claim 1, characterised in that a metal strip unwound from a coil is introduced directly into a first said forming station and that edges of the strip are cut before or after the forming operation directly in association with the forming operation, and in that the strip is cut before or after the forming operation directly in association with the forming operation.

8. The method according to claim 2, characterised in that the at least one support roller (25, 26) for the central flange (13) is displaced in a direction that is perpendicular to the central flange.

9. The method according to claim 2, characterised in that at least one said support roller (25, 26) is used for each corner (27, 28) of the central flange (13), and in that said at least one support roller is displaced in a sideways direction during a forming operation to vary the width of the central flange, whereby the support rollers are turned such that their axes (VII, VIII) are maintained perpendicular to the corners (28, 27) that make contact with the respective said support roller.

10. The method according to claim 3, characterised in that at least one said support roller (25, 26) is used for each corner (27, 28) of the central flange (13), and in that said at least one support corner is displaced in a sideways direction during a forming operation to vary the width of the central flange, whereby the support rollers are turned such that their axes (VII, VIII) are maintained perpendicular to the corners (28, 27) that make contact with the respective said support roller.

11. The method according to claim 8, characterised in that at least one said support roller (25, 26) is used for each corner (27, 28) of the central flange (13), and in that said at least one support roller is displaced in a sideways direction during a forming operation to vary the width of the central flange, whereby the support rollers are turned such that their axes (VII, VIII) are maintained perpendicular to the corners (28, 27) that make contact with the respective said support roller.

12. The method according to claim 2, characterised in that said displacements of said clamping and support rollers are carried out by means of power devices that are controlled by a computer according to pre-programmed algorithms.

13. The method according to claim 3, characterised in that said displacements of said clamping and support rollers are carried out by means of power devices that are controlled by a computer according to pre-programmed algorithms.

14. The method according to claim 4, characterised in that said displacements of said clamping and support rollers are carried out by means of power devices that are controlled by a computer according to pre-programmed algorithms.

15. The method according to claim 2, characterised in that a metal strip unwound from a coil is introduced directly into a first said forming station and that edges of the strip are cut before or after the forming operation directly in association with the forming operation, and in that the strip is cut before or after the forming operation directly in association with the forming operation.

16. The method according to claim 3, characterised in that a metal strip unwound from a coil is introduced directly into a first said forming station and that edges of the strip are cut before or after the forming operation directly in association with the forming operation, and in that the strip is cut before or after the forming operation directly in association with the forming operation.

17. A roll-forming machine with a number of forming stations (11, 12) for successively forming from a plane sheet metal strip a hat beam, that has a central flange (13), two webs (14, 15) and two side flanges (16, 17) and a cross-section that varies along its length, characterised in that the forming stations (11, 12) have a pair of clamping rollers (21, 22 and 23, 24) for the portions of the metal strip to be formed as the side flanges (16, 17) and at least one support roller (25, 26) for the portion of the metal strip to be formed as the central flange (13), and means for folding corners on peripheral edges of the clamping rollers and on peripheral edges of the support rollers such that the entire webs extend freely between the respective corners of the hat beam, the clamping roller pairs in the forming stations being arranged to be displaceable both horizontally and vertically during a forming operation.

18. The roll-forming machine according to claim 17, characterised in that the at least one support roller (25, 26) is displaceable in the vertical direction.

19. The roll-forming machine according to claim 18, characterised by two support rollers (25, 26) for the central flange located next to each other, and in that these support rollers are displaceable individually towards and away from each other, and turnable about axes (V, VI, resp.) perpendicular to the axes of the rollers.

20. The roll-forming machine according to claim 19, characterised in that each pair of clamping rollers (21, 22 and 23, 24) are turnable individually around two axes (III, IV) that are perpendicular to each other, one axis of which is parallel to the axes of the clamping rollers.

* * * * *